US011534002B2

(12) United States Patent
Perillo et al.

(10) Patent No.: US 11,534,002 B2
(45) Date of Patent: Dec. 27, 2022

(54) PIANO BENCH

(71) Applicants: Steve Perillo, Saddle River, NJ (US); David Geil, Redding, CT (US)

(72) Inventors: Steve Perillo, Saddle River, NJ (US); David Geil, Redding, CT (US)

( * ) Notice: Subject to any disclaimer, the term of this patent is extended or adjusted under 35 U.S.C. 154(b) by 0 days.

(21) Appl. No.: 17/153,730

(22) Filed: Jan. 20, 2021

(65) Prior Publication Data

US 2022/0225779 A1 Jul. 21, 2022

(51) Int. Cl.
*A47C 9/08* (2006.01)
*A47C 7/14* (2006.01)

(52) U.S. Cl.
CPC . *A47C 9/08* (2013.01); *A47C 7/14* (2013.01)

(58) Field of Classification Search
CPC .. A47C 7/14; A47C 9/08; A47C 1/023; A47C 7/626; A47C 7/628
USPC ..... 297/311, 337, 188.08, 188.09, 188.1
See application file for complete search history.

(56) References Cited

U.S. PATENT DOCUMENTS

| | | | | | |
|---|---|---|---|---|---|
| 286,457 | A * | 10/1883 | Magoun | A47C 9/08 | 297/233 |
| 621,746 | A * | 3/1899 | Brandt | A47C 9/08 | 297/188.1 |
| 1,290,517 | A * | 1/1919 | Copley | B60N 2/3011 | 297/234 |
| 1,479,645 | A * | 1/1924 | Henryb | A47C 9/08 | 312/235.5 |
| 2,166,485 | A * | 7/1939 | Monroe | A47C 9/08 | 297/188.1 |
| 2,865,427 | A * | 12/1958 | Garfield | B60N 2/062 | 297/311 X |
| 8,899,682 | B2 * | 12/2014 | Nilsson | A47C 3/18 | 297/344.24 |
| 2013/0057038 | A1 * | 3/2013 | Gloeckl | A47C 9/002 | 297/311 X |

FOREIGN PATENT DOCUMENTS

| | | | | |
|---|---|---|---|---|
| CN | 201691429 U | | 1/2011 | |
| CN | 111436788 A | * | 7/2020 | A47C 9/08 |
| DE | 3325048 A1 | * | 1/1985 | A47C 7/628 |
| EP | 3 510 893 A1 | | 7/2019 | |
| ES | 1 073 189 U | | 11/2010 | |

OTHER PUBLICATIONS

Extended European Search Report for European Application No. 22150280.0 dated Jun. 28, 2022.

* cited by examiner

*Primary Examiner* — Rodney B White
(74) *Attorney, Agent, or Firm* — Wolf, Greenfield & Sacks, P.C.

(57) ABSTRACT

A piano bench includes a base and a seat moveably mounted to the base. The seat may slide on the base via a rail positioned along the longitudinal length of the base. The rail may be positioned within an internal cavity of the base and the seat may be attached to the rail by mounting brackets that extend through elongated slots in a top cover of the base. Bumpers may be placed on or at the ends of the rails to restrict the sliding distance of the seat.

21 Claims, 4 Drawing Sheets

PIANO BENCH

FIELD

Disclosed embodiments are related to piano benches.

BACKGROUND

Piano benches are commonly used by pianists while playing the piano. A good piano bench may be ergonomically designed to optimize comfort while playing. Typical piano benches are rectangular in shape and have level seats and no backrests to promote good posture. Some benches may be adjustable in height or provide upholstered seating.

SUMMARY

In some embodiments, a piano bench includes a base and a seat moveably mounted to the base. The seat is configured to move along a longitudinal direction of the base within bounded limits.

In some embodiments, a piano bench includes a base and a seat moveably mounted to the base via a rail aligned along a longitudinal direction of the base.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
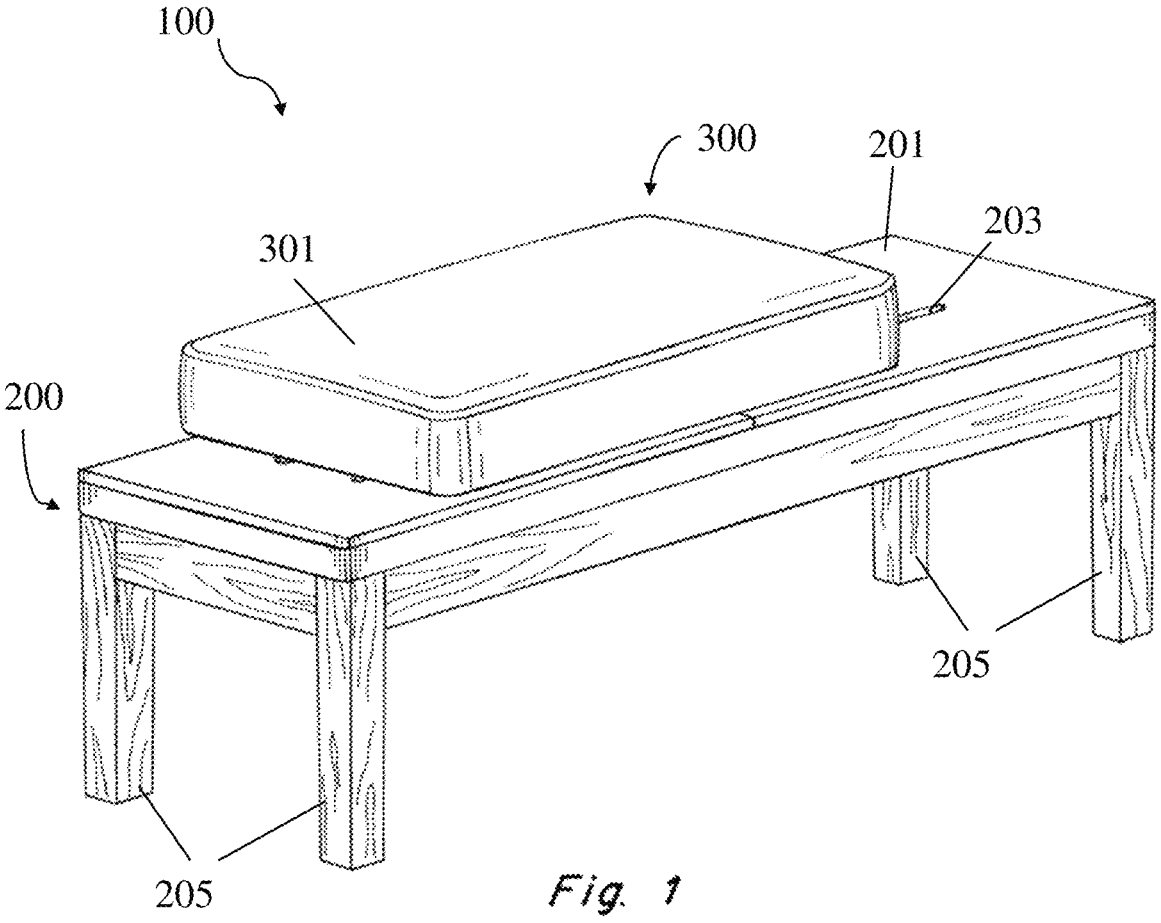
FIG. 1 is a perspective view of one embodiment of a piano bench.

The keyboard on a piano may extend up to five feet in length, and therefore pianists may need to stretch their arms, shift their seat, or even rise from a sitting position to reach the full range of notes on the keyboard. Such physical acts may be uncomfortable or difficult for pianists while playing.

The inventors have recognized and appreciated designs for a piano bench that enables pianists to slide back and forth along the bench to reach the full length of the keyboard while remaining seated. In accordance with some embodiments, the piano bench may include a seat moveably attached to a base that slides along the longitudinal length of the base. The longitudinal length of the base is described herein as the length of the bench that is configured to be positioned facing the piano keyboard. In some embodiments, the bench may be rectangular in shape, whereas the longer length of the bench comprises the longitudinal length of the bench. A rectangular bench may be 18 inches in height, 13.25 inches in width, and 36.5 inches in length, although other bench sizes and shapes (e.g., oval) may be contemplated depending on the intended use of the bench. In some embodiments, the seat may be smaller or similar in length to the base. For example, a seat that accommodates one person may be shorter in length than the base; however, a seat that accommodates two people, such as a student and a teacher, may be the same length as the base. The seat may be a rigid material, a soft material, or a combination of rigid and soft materials. In some embodiments, the seat may be a cushion mounted to a rigid substrate.

In accordance with some embodiments, the seat may slide on a rail positioned along the longitudinal direction of the base. The rail may be positioned within an internal cavity of the base. Mounting brackets may be slidably connected to the rail and extend through slots in a top cover of the base to connect the seat to the rail. The mounting brackets may slide along the rail and within the slots to slide the seat along the base of the bench. The mounting brackets may be slidably mounted to the rail to slide with controlled movements using little force. In some embodiments, the mounting bracket may hold the seat above the base creating a gap between the seat and the base such that the seat may slide over the base without touching the base. In addition, the top surface of the seat may have a surface with a low coefficient of friction such that when a pianist sitting on the seat shifts sideways, the seat shifts with the pianist, rather than the pianist sliding along the top surface of the seat. In some embodiments, the seat may have straps or other restraining devices to strap the pianist to the seat.

The inventors have further recognized and appreciated designs for a piano bench that enables the seat to slide along the longitudinal length of the base within defined limits to prevent the seat from sliding too far left or right. In accordance with some embodiments, the bench may include bumpers positioned along the rail to prevent the mounting brackets from sliding past a defined point. The position of the bumpers may be adjustable such that a pianist may adjust the sliding distance of the seat. The seat may be adjusted to slide to the edge of the base, a point before the edge of the base, or slightly over the edge of the base. For example, a seat that is the same length of the base may slide a couple of inches over the edge of the base on both sides of the base. The base may be weighted, include supports, or have fixation means to secure the base to the floor to counter any moments exerted on the bench by the seat extending over the edge of the base to avoid tipping.

The inventors have further recognized and appreciated designs for a piano bench with a removeable cover over the internal cavity. The cover may be provided in two pieces that have mirroring elongated slots extending from an inner edge of each piece. The piano bench may be assembled such that the seat and bumpers may be attached to the rail before the cover is placed on the base. Once the seat is attached, the cover pieces may be slid between the base and the seat, aligning the slots with the mounting devices. The cover may be removed at any time for a pianist to make adjustments to the bumpers to other parts in the internal cavity (e.g., tighten screws, lubricate the rail). The cover also may provide a barrier between a pianist sitting on the seat and the sliding mechanism within the internal cavity.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

FIG. 1 is a perspective view of one embodiment of the piano bench 100. As shown in FIG. 1, the bench has a base 200 and a seat 300 moveably attached to the base. The seat 300 slides back and forth along a longitudinal length of the base 200. The longitudinal length of the base is, for example, the longer length of a rectangular-shaped bench or the length of the bench that is configured to be positioned to face the keyboard of the piano. Accordingly, the seat may move back and forth in a direction along the length of the keyboard.

In accordance with some embodiments, the base includes a top cover 201 over which the seat 300 slides. The top cover 201 may be rectangular in shape and have the same width and length as the base 200 to completely cover the base. The base 200 may be supported by legs 205 of appropriate height for a pianist to sit comfortably and ergonomically at a piano. Although four legs are shown in the embodiment of FIG. 1, any number of legs or any other structure may be provided (e.g., vertical walls at opposite ends of the base, solid base) to support the base. In the embodiment of FIG. 1, the seat 300 is rectangular in shape and has a shorter length and a similar width to the base 200. For example, the base may be approximately 36 inches in length and 13 inches in width, and the seat may be approximately 22 inches in length and 14 inches in width. In such an example, the seat has a shorter length than the base and leaves approximately 14 inches of the base exposed at any time. The seat may slide along the length of the base to each end, providing a 14-inch sliding range. Although a rectangular bench is described, it should be appreciated that other shapes and dimensions for the bench, base, and/or seat may be used.

In some embodiments, the seat 300 may be mounted to a slide mechanism on the top cover 201. In some embodiments, the seat 300 may be mounted to a slide mechanism positioned within an internal cavity (see embodiments of FIGS. 2-4) of the base. The top cover 201 may include one or more slots 203 through which the slide mechanism may protrude to attach to the seat 300. The slot 203 may extend along the longitudinal length of the base to allow the slide mechanism to slide within the slot 203 along the bench 100.

Figure 2:
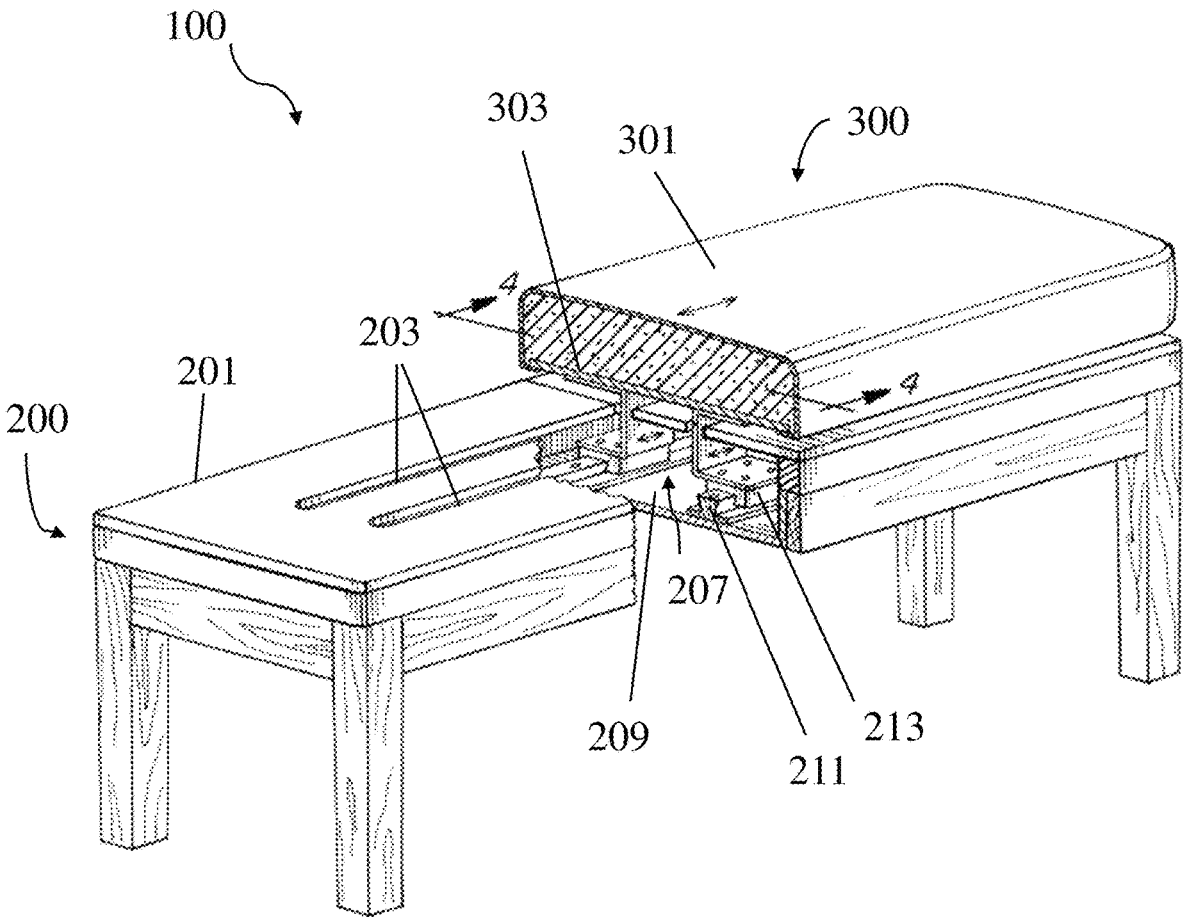
FIG. 2 is a perspective view of one embodiment of a piano bench with a partial cross-sectional cutout along line 4-4.

FIG. 2 is a perspective view of an embodiment of the piano bench 100 with a cross-sectional portion cut away to show an internal cavity 207 of the base 200. The internal cavity 207 may extend along the entire length and width of the base and have a rectangular cross section. The internal cavity 207 is defined by a bottom surface 209 and the top cover 201.

In some embodiments, a rail 211 is mounted to the bottom surface 209 of the internal cavity 207 along the longitudinal length of the base 200. Two rails are shown in the illustrated embodiment, but one or more rails may also be used in other embodiments. Mounting brackets 213 are slidably attached to the rails and may slide back and forth along the longitudinal direction of the base 200. In some embodiments, the mounting brackets 213 extend up through the top cover 201 and out of the internal cavity 207. The top cover 201 includes slots 203 that are aligned with the mounting brackets 213 to allow the mounting brackets to slide through the top cover 201. The seat 300 may be attached to the upper portion of the mounting brackets 213 that extends out of the internal cavity 207. In some embodiments, the seat may include a cushion 301 attached to a rigid base 303. The mounting bracket 213 may be attached to the rigid base 303 by any fixation means such as screws or an adhesive. When the seat 300 is attached to the mounting bracket 213, the seat 300 may slide along the longitudinal length of the base 200.

Figure 3:
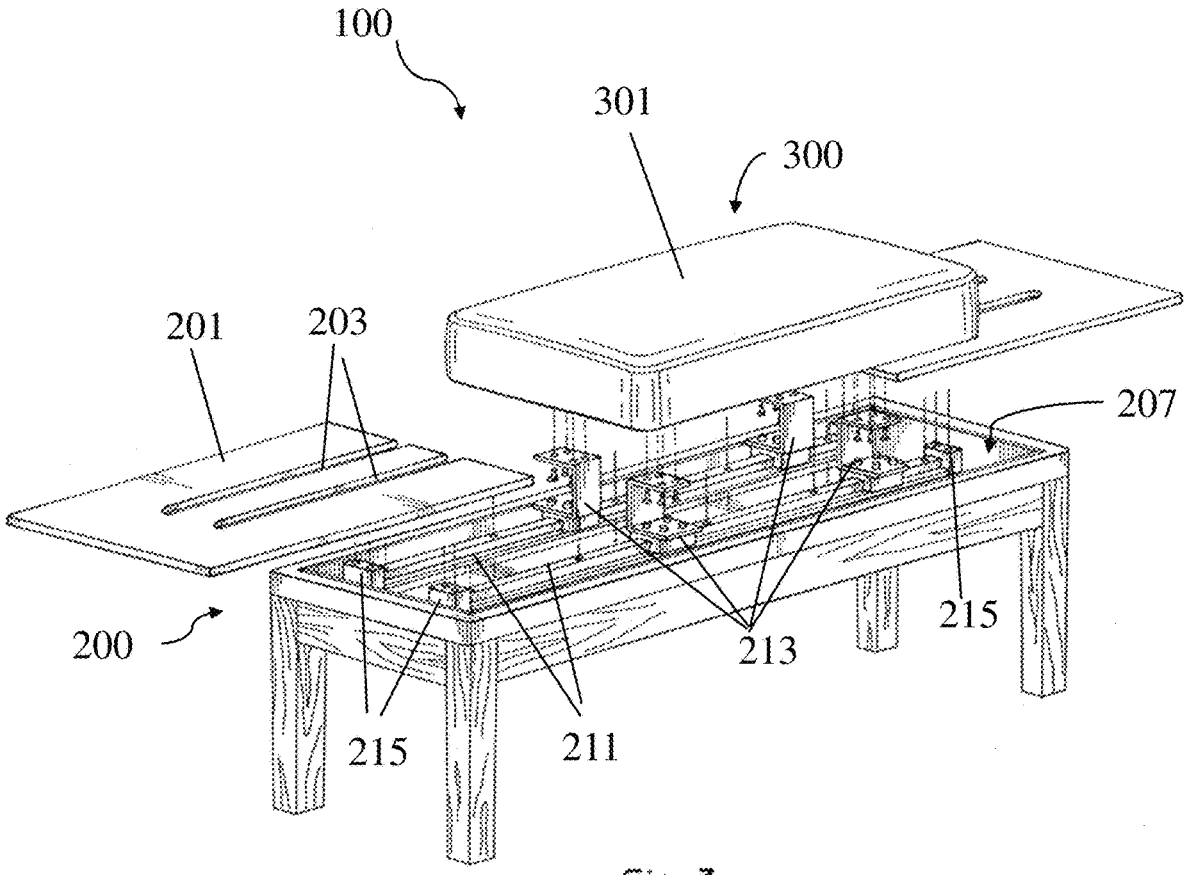
FIG. 3 is an exploded perspective view of the piano bench of FIG. 2.

FIG. 3 is an exploded view of the piano bench according to the embodiment shown in FIG. 2. In this embodiment, the piano bench 100 includes two rails 211 and two mounting brackets 213 slidably mounted to each rail. The mounting brackets 213 are attached using screws in a square pattern to the bottom of the seat 300. The rails may extend a partial distance or the entire length of the base depending on the desired sliding range and the number and placement of the mounting brackets. In some embodiments, the base may be approximately 36 inches in length and the rails may extend 30 inches in length along the base.

In some embodiments, the rails 211 may include bumpers 215 to prevent the mounting brackets 213 from sliding past a defined point on the base. The bumpers 215 may be rectangular blocks that are mounted at the end of the rails to the bottom surface 209 of the internal cavity 207 or they may be attached to or integral with the rail 211. The mounting brackets 213 may slide along the rail 211 until they contact a bumper 215 on each end, restricting the distance the mounting brackets 213 can slide along the base. In some embodiments, the bumpers 215 may be repositioned along the rail 211 to adjust the sliding distance of the seat 300 toward each side of the bench. The seat 300 may slide to the edge of the base 200 on each side or it may slide to a point before each edge. In some embodiments, the seat 300 may slide past the edge of the base.

In some embodiments, the top cover 201 may be removable and may be provided in two separate pieces. A removeable cover may allow adjustments to be made to any components inside the internal cavity 207 such as adjusting the position of the bumpers 215.

In some embodiments, the piano bench 100 may be assembled by installing the rail with attached mounting brackets 213 to the bottom surface 209 of the internal cavity 207. The seat 300 may then be attached to the mounting brackets 213. The bumpers 215 may be attached before or after the seat 300. Once the seat 300 is attached, a pianist may adjust the bumpers 215 to set the desired seat sliding distance. The top cover 201 may then be installed by sliding the top cover 201 between the base and the seat 300. The slots 203 in the top cover 201 align with the mounting brackets 213 to allow the cover to slide around the mounting brackets 213. In some embodiments, the top cover 201 is provided in two separate pieces that may be slid between the seat 300 and base 200 on either side of the seat. The top cover pieces each have slots 203 extending from an inside edge that line up when the two inside edges are connected on the base 200. Once the top cover 201 is attached, the mounting brackets 213 may slide back and forth in a longitudinal direction along the base 200 within the slots 203. Accordingly, the seat 300 may slide in a longitudinal direction along the base 200.

Figure 4:
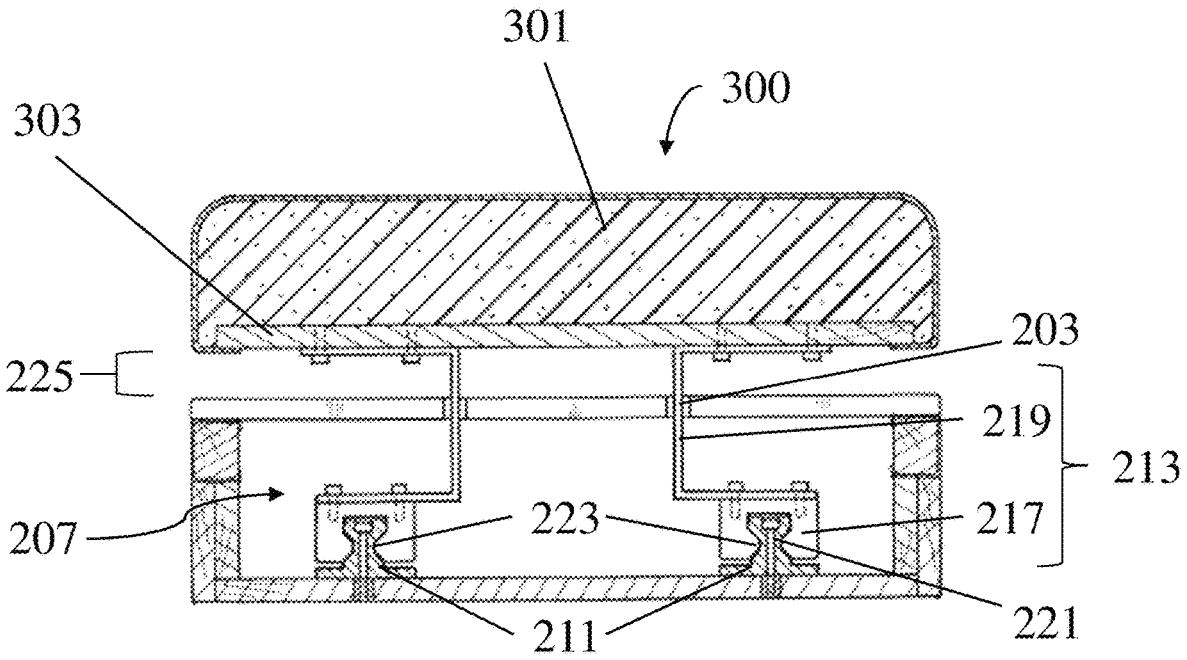
FIG. 4 is the cross-sectional view of the piano bench of FIG. 2 taken along line 4-4.

FIG. 4 shows a cross-sectional view of the piano bench according to the embodiment of FIG. 2 taken along line 4-4. FIG. 4 illustrates the connections among the rails 211, mounting brackets 213, and seat 300 according to some embodiments. In some embodiments, the mounting bracket 213 may include a sliding portion 217 and a connector portion 219. The sliding portion 217 slidably attaches to the rail and the connector portion 219 attaches to the seat 300. The sliding portion 217 and the connector portion 219 maybe connected to each other by any fixation means (e.g., screws) or they may be integrally formed.

The rails 211 may be attached to the bottom surface 209 of the internal cavity 207 using screws. The rails 211 may include a projection 221 that extends in an upward direction. The sliding portion 217 of the mounting brackets 213 may be mounted over the projections 221. The projection 221 and the sliding portion 217 may have complementary shapes that form a contiguous border. In some embodiments, bearings, ball casters, wheels or other rollers, and/or lubricant may be utilized in the border between the rail projections 221 and sliding portions 217 to help the mounting brackets 213 slide smoothly along the rail 211.

In some embodiments, the projections 221 may have cutouts 223 on one or both sides of the projection that extend along the longitudinal length of the rail 211. For example, the cross section of the rail projection 221 may decrease as the projection extends upward and then increase toward the top of the projection. The sliding portion 217 may have a complementary shape that extends into the cutout 223 to create a snug fit. This may help prevent the mounting bracket 213 from tilting or separating from the rail 211.

In accordance with some embodiments, when assembling the piano bench 100, the sliding portion 217 may be mounted to the rail 211 by sliding it onto one end of the rail and then sliding it toward the center of the rail. Bumpers 215 (FIG. 3) may then be attached on the ends of the rails to prevent the sliding portion from sliding past a defined point. Due to cutouts 223 on the projections 221 and the complementary-shaped sliding portion 217, the movement of the mounting bracket 213 may be restricted in all directions except sliding a fixed distance along the rail 211 (e.g., cannot tilt or be pulled off the rail).

In some embodiments, the connector portion 219 of the mounting bracket 219 is shaped as a C-bracket. As shown in FIG. 4, the C-bracket includes horizontal sections that attach to the sliding portion 217 and the seat 300 and a vertical section between the horizontal sections that extends through the slots 203 in the top cover 201. Although four C-brackets are described with reference to FIG. 4, any number of any shaped connector bracket may be used to attach the seat 300 to the sliding portion 217. For example, one U-shaped bracket may be used rather than two separate C-brackets. The lower ends of the U-bracket may connect to two opposing mounting brackets 213 while the middle upper section connects to the seat 300.

In some embodiments, the mounting bracket 213 holds the seat 300 a specified distance above the base 200, creating a gap 225 between the seat 300 and top cover 201. This gap may be between approximately ⅛ inch and ¼ inch. As a result, the seat 300 may slide over the base without touching the top cover 201.

Although embodiments described herein include a rail attached to the base, the bench may also be arranged with other configurations, including mounting a rail to a bottom surface of the seat. In such a configuration, the rail may be slidably mounted to one or more mounting brackets that extend from the top of the base.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A piano bench comprising:

a base comprising an internal cavity and a cover arranged on top of the internal cavity; and a seat moveably mounted to the base, wherein the seat is arranged on top of the cover and is configured to move along a longitudinal length of the base within bounded limits, wherein the seat is moveably mounted to the base via a rail positioned in the internal cavity of the base along a longitudinal direction of the base.

2. The piano bench of claim 1, further comprising a bumper configured to prevent the seat from sliding beyond a defined distance.

3. The piano bench of claim 2, wherein the defined distance comprises the seat stopping past or before the edge of the base.

4. The piano bench of claim 2, wherein the defined distance comprises the seat stopping at an edge of the base.

5. The piano bench of claim 1, wherein the seat has a length smaller than a length of the base.

6. The piano bench of claim 1, wherein the seat comprises a cushion.

7. The piano bench of claim 1, wherein the cover comprises a slot, and wherein a mounting bracket attaches the seat to the rail, and the mounting bracket extends through the slot.

8. The piano bench of claim 7, wherein the mounting bracket comprises a C-bracket.

9. The piano bench of claim 1, wherein the seat has a length the same as a length of the base.

10. A piano bench comprising:

a base comprising an internal cavity and a cover arranged on top of the internal cavity; and a seat moveably mounted to the base via a rail aligned along a longitudinal direction of the base, wherein the rail is positioned in the internal cavity and the seat is arranged on top of the cover.

11. The piano bench of claim 10, further comprising a mounting bracket that attaches the seat to the rail, wherein the mounting bracket slides along the rail.

12. The piano bench of claim 11, wherein the mounting bracket and the rail have complementary shapes such that the mounting bracket fits snuggly over the rail.

13. The piano bench of claim 12, wherein the rail comprises a middle cross section having a width smaller than a width of a top cross section and a width of a bottom cross section.

14. The piano bench of claim 11, wherein the cover comprises a slot, and wherein the mounting bracket extends through the slot.

15. The piano bench of claim 14, wherein the mounting bracket comprises a C-bracket mounted to a sliding portion that fits onto the rail, wherein the C-bracket extends through the slot.

16. The piano bench of claim 14, further comprising a gap between a top surface of the cover and a bottom surface of the seat.

17. The piano bench of claim 14, wherein the cover comprises at least two sections, wherein each section includes a portion of the slot.

18. The piano bench of claim 10, further comprising a bumper arranged on the rail to prevent the seat from sliding past a defined distance.

19. The piano bench of claim 10, wherein the seat has a length the same as a length of the base.

20. A piano bench comprising:

a base comprising an internal cavity and a cover arranged on top of the internal cavity;

a seat moveably mounted to the base, wherein the seat is configured to move along a longitudinal length of the base within bounded limits, wherein the seat is moveably mounted to the base via a rail positioned in the internal cavity of the base along a longitudinal direction of the base, wherein the cover comprises a slot, and wherein a mounting bracket attaches the seat to the rail, and the mounting bracket extends through the slot.

21. A piano bench comprising:

a base comprising an internal cavity and a cover arranged on top of the internal cavity;

a seat moveably mounted to the base via a rail aligned along a longitudinal direction of the base, wherein the rail is positioned in the internal cavity; and a mounting bracket that attaches the seat to the rail, wherein the mounting bracket slides along the rail, and wherein the cover comprises a slot, and wherein the mounting bracket extends through the slot.

* * * * *